US010998649B2

(12) United States Patent
Lüdke et al.

(10) Patent No.: US 10,998,649 B2
(45) Date of Patent: May 4, 2021

(54) SPRING-FORCE CONNECTION AND ROUND PLUG-IN CONNECTOR WITH A LARGE NUMBER OF SPRING-FORCE CONNECTIONS

(71) Applicant: PHOENIX CONTACT GMBH & CO. KG, Blomberg (DE)

(72) Inventors: Michael Lüdke, Vlotho (DE); Frank Mellies, Detmold (DE); Jörg Hohmeier, Lügde (DE); Falk Langer, Zwönitz (DE); Torsten Tasche, Markkleeberg (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 16/487,503

(22) PCT Filed: Feb. 20, 2018

(86) PCT No.: PCT/EP2018/054155
§ 371 (c)(1),
(2) Date: Aug. 21, 2019

(87) PCT Pub. No.: WO2018/153862
PCT Pub. Date: Aug. 30, 2018

(65) Prior Publication Data

US 2020/0059014 A1 Feb. 20, 2020

(30) Foreign Application Priority Data

Feb. 27, 2017 (BE) ..... 2017/5116

(51) Int. Cl.
*H01R 9/22* (2006.01)
*H01R 4/48* (2006.01)
*H01R 9/24* (2006.01)

(52) U.S. Cl.
CPC ..... *H01R 4/4836* (2013.01); *H01R 9/2491* (2013.01)

(58) Field of Classification Search
CPC .. H01R 4/4809; H01R 4/4818; H01R 4/4827; H01R 4/4836; H01R 4/4845
(Continued)

(56) References Cited

U.S. PATENT DOCUMENTS 5,726,619 A * 3/1998 Hohorst ..... H01R 9/24 336/192
6,146,187 A * 11/2000 Pallai ..... H01R 4/4836 439/431
(Continued)

FOREIGN PATENT DOCUMENTS

CN 102132460 A 7/2011
CN 102204015 A 9/2011
(Continued)

OTHER PUBLICATIONS

Chinese Office Action dated May 8, 2020 in CN Application No. 201880014189.6.
(Continued)

*Primary Examiner* — Khiem M Nguyen
(74) *Attorney, Agent, or Firm* — Occhiuti & Rohlicek LLP

(57) ABSTRACT

A spring-force connection having a housing part, a pivot lever, an electrically conductive connecting device and a contact spring by means of which a conductor (L) can apply force to the connecting device. The contact spring can be pivoted between release and clamping positions and has a pressing and a clamping limb, connected to the pressing limb using a bending joint. The pivot lever has a driver and the pressing limb is arranged between the pressing device and the driver in the closed position of the pivot lever and,
(Continued)

Figure 1A:
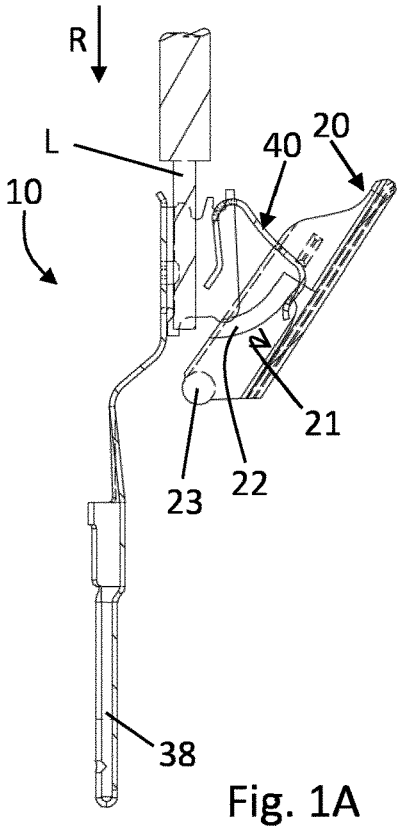
Figure 1B:
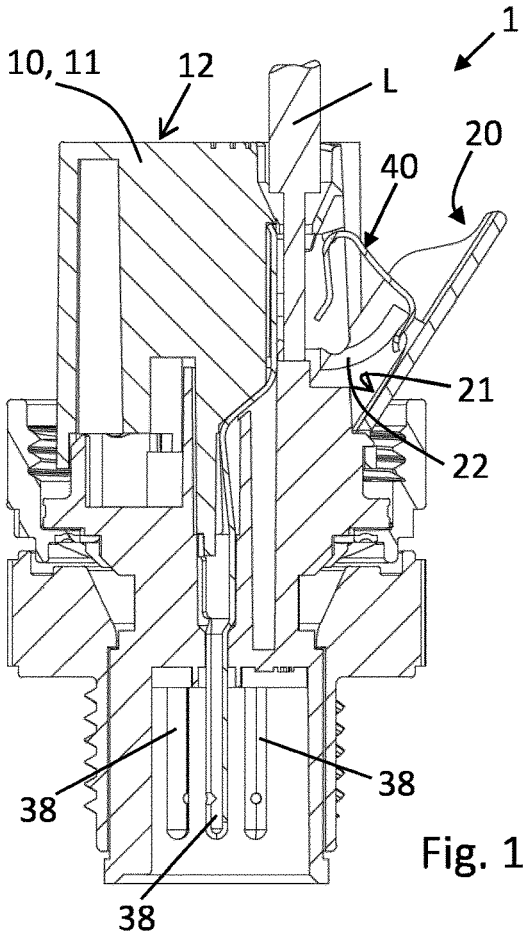
Figure 2A:
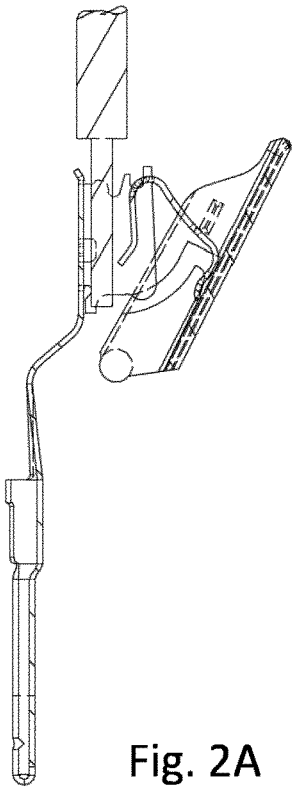
Figure 2B:
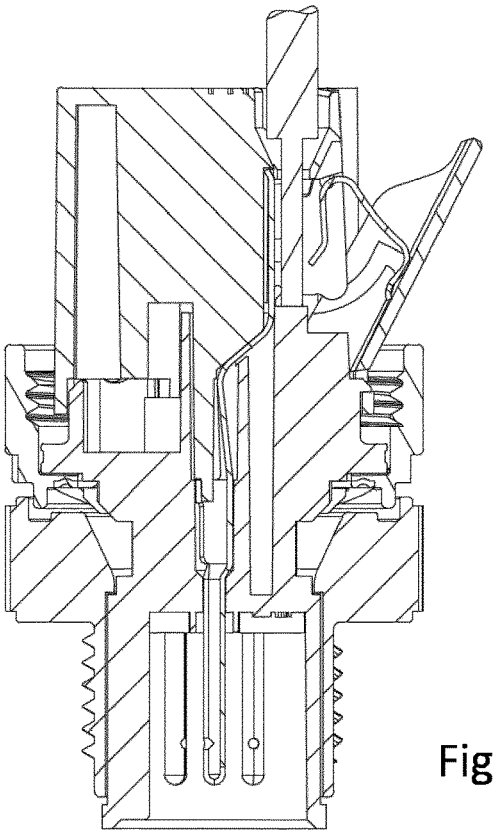

by pivoting the pivot lever into its closed position, the pressing device can indirectly apply force to the pressing limb so that the contact spring is pivoted into its clamping position, so that the conductor applies force to the connecting device with the clamping limb and, by pivoting the pivot lever into its open position, the driver can indirectly apply force to the pressing limb so that the contact spring is pivoted into its release position.

20 Claims, 6 Drawing Sheets

(58) Field of Classification Search
USPC ..... 439/708, 709, 712
See application file for complete search history.

(56) References Cited

U.S. PATENT DOCUMENTS

| | | | | |
|---|---|---|---|---|
| 6,341,989 | B1 * | 1/2002 | Jaag | H01R 4/4827 439/725 |
| 2011/0151699 | A1 | 6/2011 | Schafmeister | |

FOREIGN PATENT DOCUMENTS

| | | | |
|---|---|---|---|
| CN | 104380531 | A | 2/2015 |
| CN | 104779450 | A | 7/2015 |
| CN | 205092351 | U | 3/2016 |
| DE | 102010011371 | A1 | 9/2011 |
| DE | 102010048698 | | 4/2012 |
| DE | 102013110431 | A1 | 3/2015 |
| DE | 102014117699 | A1 | 6/2016 |
| DE | 102014117699 | A1 | 6/2016 |
| DE | 102014117949 | A1 | 6/2016 |
| EP | 0780923 | A2 | 6/1997 |
| EP | 2835870 | A2 | 2/2015 |
| EP | 2864718 | | 7/2015 |
| EP | 2894718 | A2 | 7/2015 |
| JP | 2012-501056 | A | 1/2012 |
| TW | 201608789 | A | 3/2016 |
| WO | 2010022955 | | 3/2010 |
| WO | 20101022955 | A1 | 3/2010 |
| WO | 2011151393 | A1 | 8/2011 |
| WO | 2016/083966 | A1 | 6/2016 |
| WO | 20016083966 | | 6/2016 |

OTHER PUBLICATIONS

Japanese Office Action dated Sep. 10, 2020 in JP Application No. 2019-546320.

European Office Action dated Dec. 10, 2020 in EP Application No. 18705650.2.

* cited by examiner

SPRING-FORCE CONNECTION AND ROUND PLUG-IN CONNECTOR WITH A LARGE NUMBER OF SPRING-FORCE CONNECTIONS

CROSS-REFERENCE TO RELATED APPLICATIONS

This application is the U.S. National Stage of International Application No. PCT/EP2018/054155, filed on Feb. 20, 2018, which claims the priority of Belgium Application No. 2017/5116, filed on Feb. 27, 2017.

The present invention concerns spring-force connections and round plug-in connectors with a large number of spring-force connections.

Spring-force connections, by means of which two electrical conductors for example can be connected together, are known from the prior art.

DE 10 2010 048 698 A1 describes an electrical connecting clamp with an insulating housing and a spring clamp connection arranged therein; wherein the spring clamp connection has a caged tension spring having a contact leg lying on a conductor rail portion, a backward spring bend adjoining this, and an actuating leg; wherein the actuating leg has a window opening on a clamping portion bent in the direction of the conductor rail portion, through which opening the conductor rail portion is guided and the lower transverse web of which forms a clamping point for clamping an electrical conductor between the transverse web and the conductor rail portion; and wherein a tab of the actuating leg protrudes forward and to the outside in the opposite direction to the backward spring bend; wherein the spring clamp connection has an actuating lever which is mounted pivotably in front of the clamping portion of the actuating leg of the cage tension spring adjacent to the tab and has a contact point oriented for contact on the tab.

The connecting clamp constructed in this way has a complex geometry. In particular, the caged tension spring must have a complex geometry with a plurality of bends and a window opening in order to guarantee its functionality. Furthermore, a conductor can only be introduced into the connecting clamp and be clamped by the caged tension spring when the caged tension spring is in its release position.

The object on which the present invention is based is to provide an improved spring-force connection with a simpler structure, and with easier and more flexible handling.

This object is achieved by a spring-force connection with the features of claim 1 of the present invention. Advantageous embodiments are described in the claims dependent on claim 1.

More precisely, the object on which the present invention is based is achieved with a spring-force connection having a housing part, a pivot lever which can be pivoted between an open position and a closed position, an electrically conductive connecting device which is accessible via a conductor insertion opening of the housing part, and a contact spring by means of which a conductor, which is inserted into the housing part via the conductor insertion opening, can be force-loaded onto the connecting device, wherein the spring-force connection is characterized in that the contact spring, which can be pivoted between a release position and a clamping position, has a pressing leg and a clamping leg which is connected to said pressing leg by means of a bending joint, wherein the pivot lever has a pressing device and a driver, wherein the pressing leg is arranged between the pressing device and the driver at least in the closed position of the pivot lever, wherein by pivoting of the pivot lever into its closed position, the pressing device can at least indirectly apply force to the pressing leg such that the contact spring is pivoted into its clamping position, so that a conductor which is inserted into the housing part via the conductor insertion opening is force-loaded onto the connecting device by means of the clamping leg, and wherein by pivoting of the pivot lever into its open position, the driver can at least indirectly apply force to the pressing leg such that the contact spring is pivoted into its release position.

The spring-force connection according to the invention and in particular the contact spring have a simple structure. Therefore assembly of the spring-force connection is easier. Despite the simple structure of the spring-force connection, a forced coupling between the position of the pivot lever and the position of the contact spring remains guaranteed.

Movement of the pivot lever is accordingly force-coupled to a pivoting of the contact spring, wherein in particular the transfer of the contact spring into its release position must take place by means of the pivot lever. When the pivot lever is transferred into its closed position, the contact spring is pivoted into its clamping position by driving of the pressing leg, and when the pivot lever is transferred into its open position, the contact spring is pivoted into its release position by driving of the pressing leg. In other words, by means of the pivot lever, the contact spring can be actively pivoted between the release position and the clamping position. Accordingly, on pivoting of the pivot lever, the contact spring is always force-loaded or driven by the pivot lever.

In addition, the spring-force connection according to the invention has simple handling since the spring-force connection according to the invention can be operated single-handedly. To connect an electrical conductor to the spring-force connection, preferably the pivot lever is pivoted into its open position, wherein this is not absolutely essential, as will be explained below. Since the pivot lever remains in its open position, the electrical conductor can then be introduced into the spring-force connection via the conductor insertion opening, whereupon the pivot lever is pivoted into its closed position. This actuation can be performed single-handedly.

The spring-force connection serves in particular to connect an electrical conductor to a further electrical connecting device, e.g. an electrical contact pin or an electrical connection socket. The housing part in this case has a conductor insertion opening for each pole, via which electrical conductors can be introduced into the housing part and can each be brought into contact with the connecting device.

Both the housing part and the pivot lever are formed from an electrically insulating material or comprise an electrically insulating material at the points at which they come into contact with the electrical conductors or the contact spring. The electrically insulating material is in particular a plastic.

The contact spring, which in particular may be formed as a leg spring, preferably consists of or comprises a spring steel, at least in the region of the bending joint. Furthermore, the contact spring may be pivoted about a pivot axis which is defined by the housing part and/or the connecting device and/or the geometry of the contact spring.

The pressing device may also be called a first driver, a first pressing element or a first pressing face. The pressing device is preferably formed as part of an inner face of the pivot lever. The driver may also be described as a second driver, a second pressing edge, a return edge, a return pin or a return lug.

The electrically conductive connecting device preferably comprises a current bar.

The pressing leg is at least indirectly force-loaded by means of the pressing device or driver of the pivot lever, preferably by means of a latching leg which is connected to the pressing leg via a latching joint.

At least in the closed position of the pivot lever, the latching leg is arranged between the pressing device and the driver.

Preferably, the spring-force connection is configured such that the contact spring furthermore comprises a latching leg connected to the pressing leg via a latching joint and arranged between the pressing device and the driver, wherein the contact spring is formed elastically at least in portions, and an angle enclosed between the pressing leg and the latching leg is variable, wherein when the contact spring is pivoted in the direction of its clamping position, the latching leg comes into contact with a latching device of the spring-force connection, wherein the angle between the latching leg and the pressing leg can be increased by a closing force exerted by means of the pivot lever, wherein in the closed position of the pivot lever, the latching leg engages behind the latching device so that the pivot lever is able to pivot in the direction of its open position only under elastic deformation of the latching joint, and wherein on pivoting of the contact spring in the direction of its release position, the driver applies force to the latching leg such that the angle between the latching leg and the pressing leg is increased by the opening force exerted by means of the pivot lever.

The spring-force connection formed in this way has the advantage that, in the closed position of the pivot element, the contact spring engages with a latching device of the spring-force connection so that the pivot lever can only be pivoted into its open position by overcoming a predefined opening force. This guarantees a secure contacting of the electrical conductor connected to the spring-force connection.

By pivoting the pivot lever into its closed position, the pressing device applies force to the latching leg and hence indirectly to the pressing leg, such that the contact spring is pivoted into its clamping position, so that a conductor introduced into the housing part via the conductor insertion opening is force-loaded onto the connecting device by means of the clamping leg.

When the pivot element is pivoted into its open position, the driver applies force to the latching leg and hence indirectly to the pressing leg, such that the contact spring is pivoted into its release position.

By increasing the angle between the latching leg and the pressing leg, the latching leg no longer engages behind the latching device, so that the contact spring can pivot into its release position virtually without resistance when the pivot lever is pivoted into its open position.

A predefined bending of the latching joint is preferably in the same direction as a predefined bending of the bending joint.

The latching joint may be described as a second bending joint of the contact spring. The bending joint between the pressing leg and the clamping leg is then known as the first bending joint.

The latching device may also be called a latching lug or a latching protrusion. The latching device may be formed as part of the housing part.

Further preferably, the spring-force connection is configured such that the electrically conductive connecting device has a spring basket with two side walls and a conductor rail arranged between the side walls, wherein an electrical conductor can be positioned between the side walls of the spring basket via the conductor insertion opening in an insertion direction, wherein an electrical conductor positioned between the side walls can be force-loaded onto the conductor rail by pivoting of the contact spring into its clamping position by means of the clamping leg, and wherein the latching device has at least one latching protrusion formed on an edge of a side wall facing away from the conductor insertion opening.

The spring basket is preferably connected electrically to the conductor rail, which could also be called a current bar. Further preferably, the spring basket and the conductor rail are formed integrally. Even further preferably, the spring basket has a U-shaped cross-sectional geometry.

When the contact spring is in the clamping position, the clamping leg force-loads the electrical conductor onto the conductor rail.

Preferably, the spring-force connection is configured such that the contact spring has two pivot pegs which extend laterally in opposite directions from the bending joint and define a pivot axis of the contact spring about which the contact spring can pivot between the release position and the clamping position.

Further preferably, the spring-force connection is configured such that a groove is formed in each of the two side walls of the spring basket on an edge facing the conductor insertion opening, wherein the contact spring is suspended in the spring basket such that the pivot pegs are arranged in the grooves of the side walls.

By corresponding design of the contact spring and spring basket, the contact spring can be suspended in the spring-force connection in a particularly simple fashion, so that the structure and installation of the correspondingly formed spring-force connection are particularly simple.

Preferably, the spring-force connection is configured such that a pivot axis of the contact spring, about which the contact spring can pivot between the release position and the clamping position, is arranged between the conductor insertion opening and the pressing device and/or the driver of the pivot lever.

Further preferably, the spring-force connection is configured such that the pressing device and the driver of the pivot lever are arranged between the conductor insertion opening and a pivot lever axis about which the pivot lever can pivot between the open position and the closed position.

By corresponding arrangement of the pivot axis of the contact spring and the pivot lever pivot axis, the pivot lever and contact spring always pivot in opposite directions. This means that if, for example, the pivot lever is pivoted clockwise from its open position to its closed position, the contact spring pivots counterclockwise from its release position into its clamping position. Thus the correspondingly formed contact plug has a very compact structure.

Preferably, the spring-force connection is configured such that the contact spring is configured elastically at least in portions, and an angle enclosed between the pressing leg and the clamping leg is variable so that when the contact spring is in the clamping position, a conductor can be introduced into the housing part via the conductor insertion opening and positioned between the clamping leg and the conductor rail under elastic deformation of the contact spring.

A correspondingly formed spring-force connection offers the advantage that, despite the pivot element being in the closed position and the contact spring accordingly being in the clamping position, a preferably rigid conductor can still be introduced into the housing part via the conductor insertion opening and brought into connection with the connecting device, wherein furthermore it remains guaranteed that the conductor is force-loaded onto the connecting device and hence clamped by means of the contact spring. The handling of the correspondingly formed spring-force connection is thereby substantially improved, since the pivot element need not necessarily be pivoted into its release position in order for an electrical conductor to be contacted using the spring-force connection.

Further preferably, the spring-force connection is configured such that the connecting device has a conductor rail with which a conductor, introduced into the housing part via the conductor insertion opening, can be brought into contact, wherein when the contact spring is in the clamping position, the clamping leg and the conductor rail enclose an angle, open towards the conductor insertion opening, of less than or equal to 90°.

With corresponding design of the spring-force connection and in particular the contact spring, a further simplified insertion of a conductor is possible despite the pivot element being in its closed position. Furthermore, with a corresponding angular position of the clamping leg towards the conductor which has been introduced into the connecting device, it is guaranteed that the clamping leg of the contact spring counters undesirable extraction of the conductor in an improved fashion, since the edge of the clamping leg of the contact spring digs into the conductor when the conductor is extracted from the housing part.

The present invention is furthermore based on the object of providing an improved round plug-in connector which has a simple structure, with easy and flexible handling.

This object is achieved by a round plug-in connector with the features of claim 10.

More precisely, the object on which the present invention is based is achieved by a round plug-in connector with a large number of spring-force connections as described above, wherein a housing of the round plug-in connector forms the housing parts of the spring-force connections, and wherein the respective conductor insertion openings of the spring-force connections are arranged on an end face of the housing.

The housing preferably receives a number of pivot levers, connecting devices and contact springs corresponding to the number of poles.

Preferably, the round plug-in connector is configured such that the respective spring-force connections are arranged relative to each other such that the respective pivot levers of the spring-force connections are arranged with an angular offset to each other on a circumference of the housing.

By corresponding design of the round plug-in connector, this is particularly compact in structure. Furthermore, operation of the pivot lever is simplified with a corresponding arrangement.

Figure 8A:
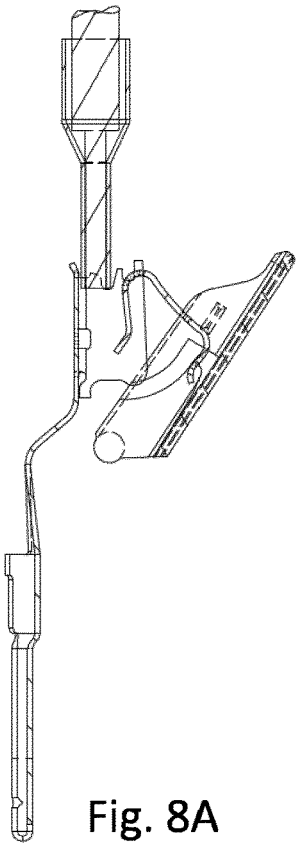
Figure 8B:
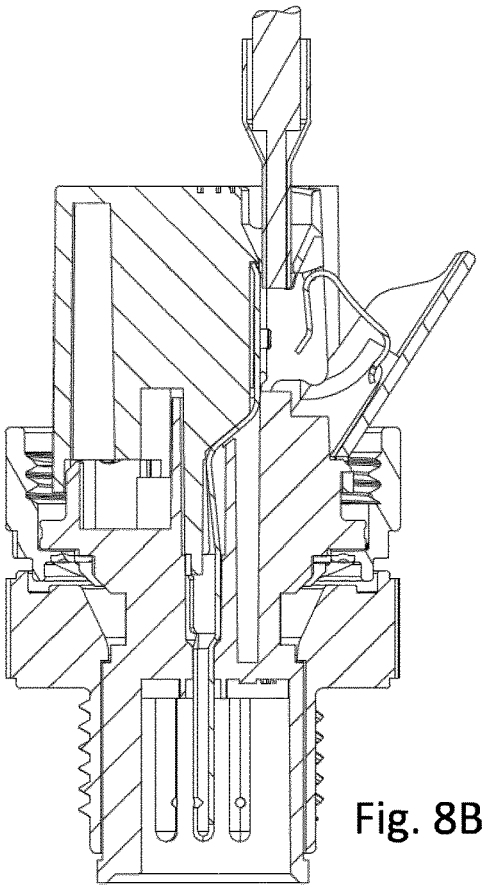
Figure 9:
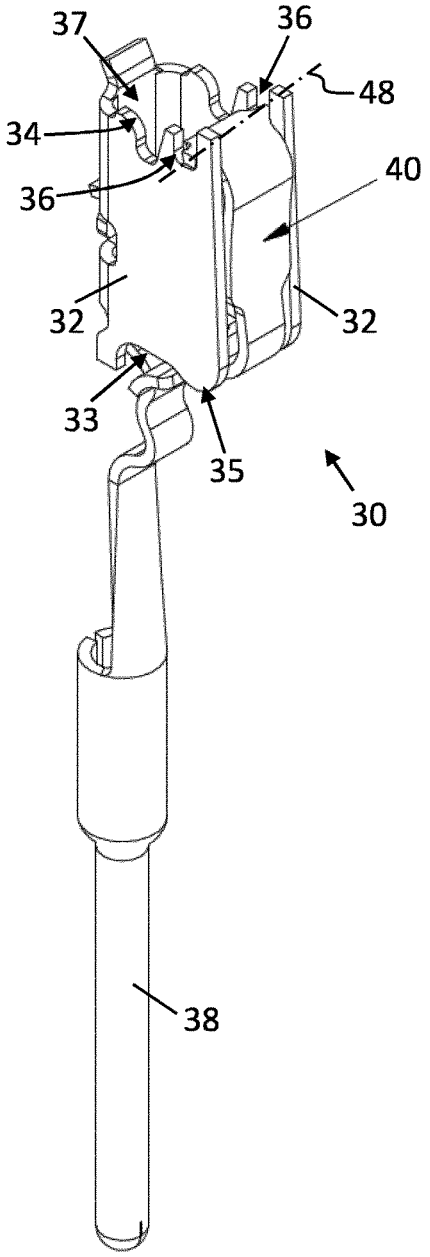
Figure 10A:
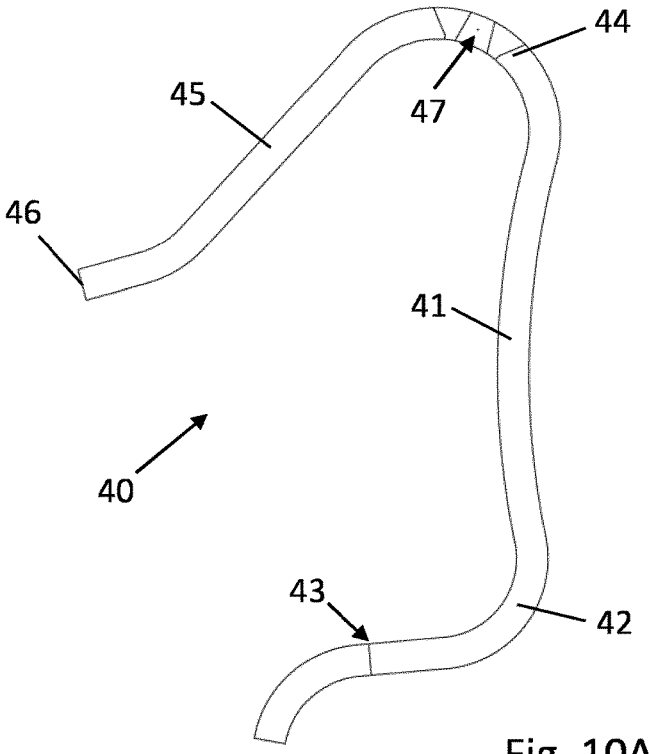
Figure 10B:
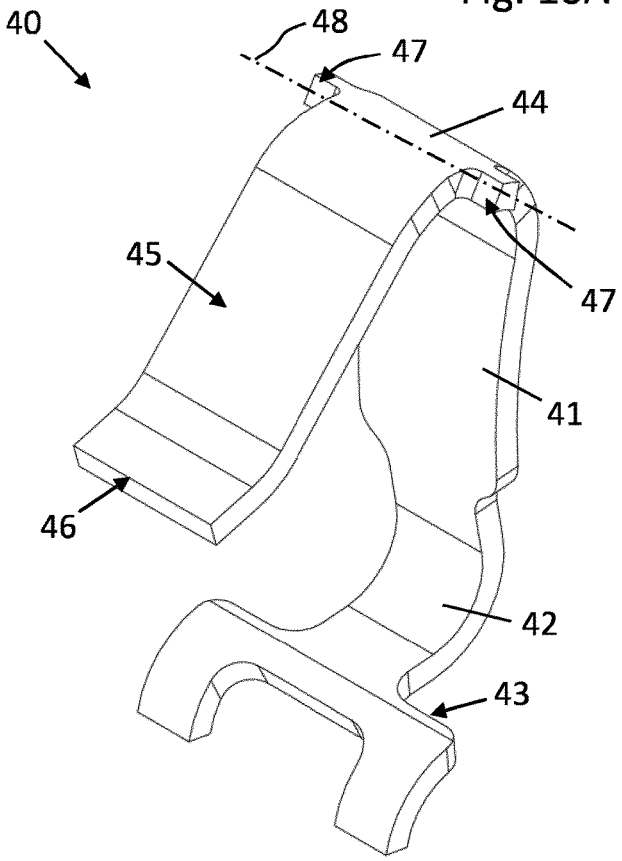
Figure 11A:
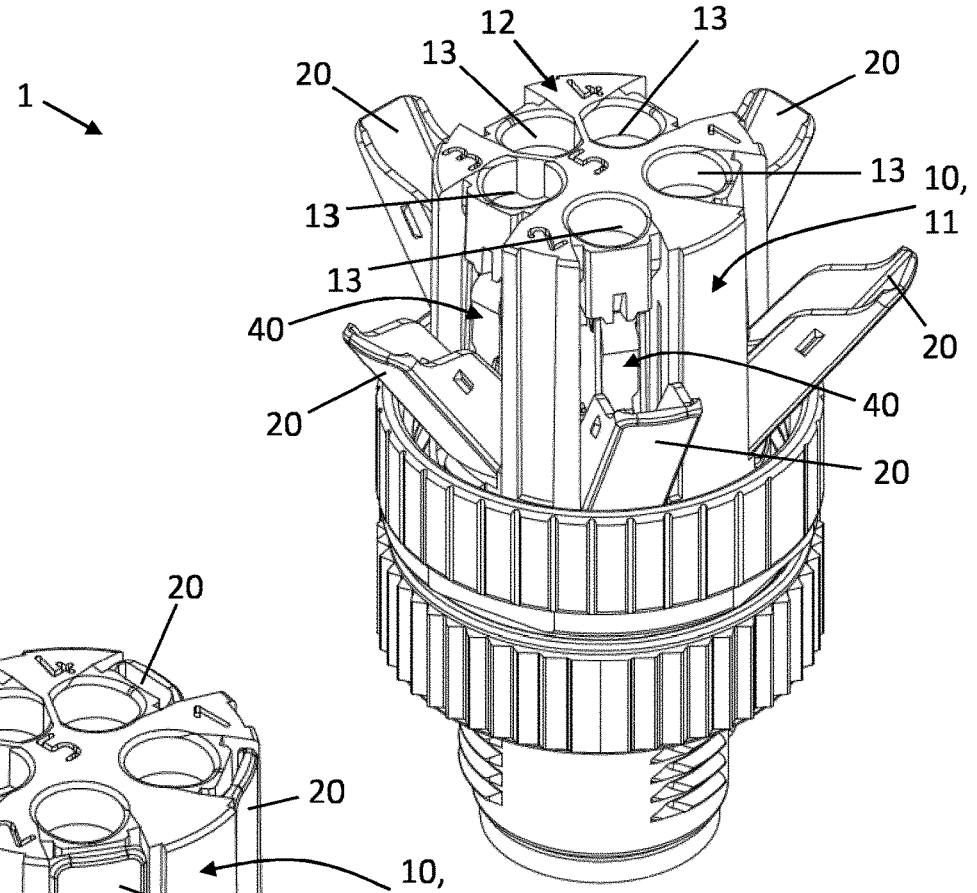
Figure 11B:
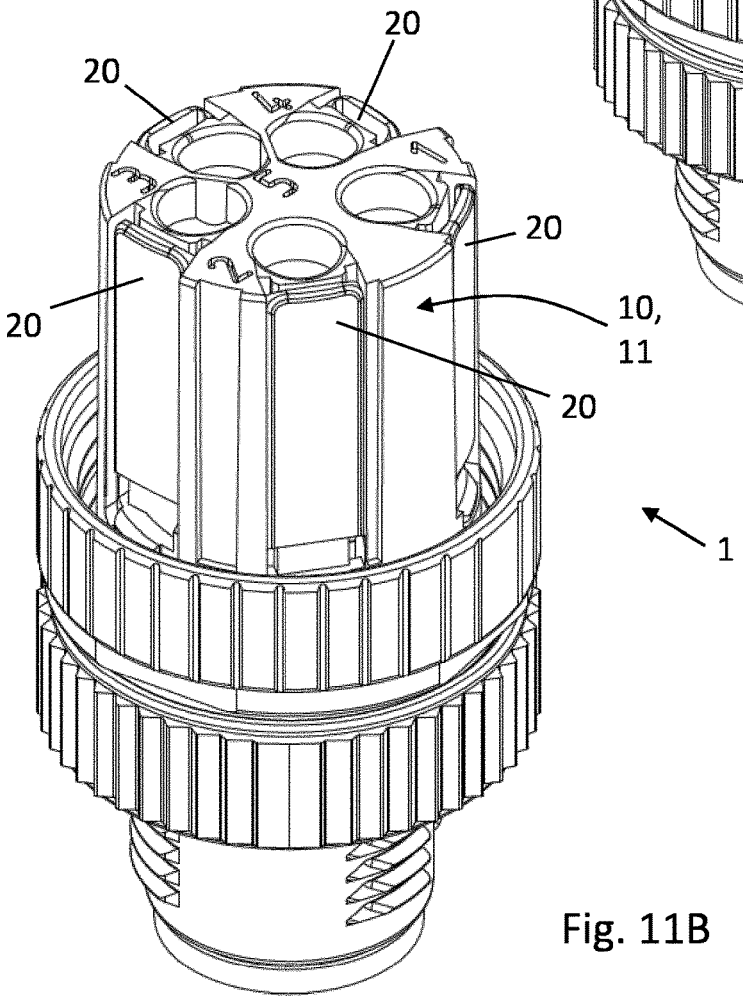

Further advantages, details and features of the invention arise from the exemplary embodiments explained below. The drawings show in detail:

FIGS. 1A to 4A: a side cross-sectional depiction of a spring-force connection according to the invention in various phases of transfer of a pivot lever from its open position to its closed position, wherein a housing part of the spring-force connection is not shown;

FIGS. 1B to 4B: a side cross-sectional depiction of a round plug-in connector with an integrated spring-force connection in various phases of transfer of a pivot lever from its open position to its closed position;

FIGS. 5*a* to 8A: a side cross-sectional depiction of the spring-force connection according to the invention in various phases of transfer of a pivot lever from its closed position to its open position, wherein a housing part of the spring-force connection is not shown;

FIGS. 5B to 8B: a side cross-sectional depiction of a round plug-in connector with an integrated spring-force connection in various phases of transfer of a pivot lever from its closed position to its open position;

FIG. 9: a perspective view of the spring-force connection according to the invention as shown in FIGS. 1A to 8A, without its housing part and without its pivot lever;

FIG. 10A: a side view of a contact spring of the spring-force connection according to the invention;

FIG. 10B: the contact spring shown in FIG. 10A in perspective depiction;

FIG. 11A: a perspective depiction of the round plug-in connector shown in FIGS. 1B to 8B with five integrated spring-force connections according to the invention, wherein all pivot levers are in their open position; and FIG. 11B: the round plug-in connector shown in FIG. 11A, wherein all pivot levers are in their closed position.

In the description which follows, the same reference signs designate the same components or the same features, so that a description given with reference to one figure relative to one component also applies to the other figures, so as to avoid repetition. Furthermore, individual features which have been described in connection with one embodiment may also be applied separately in other embodiments.

Figure 3A:
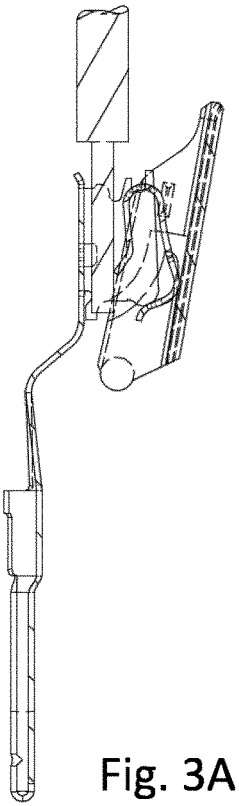
Figure 3B:
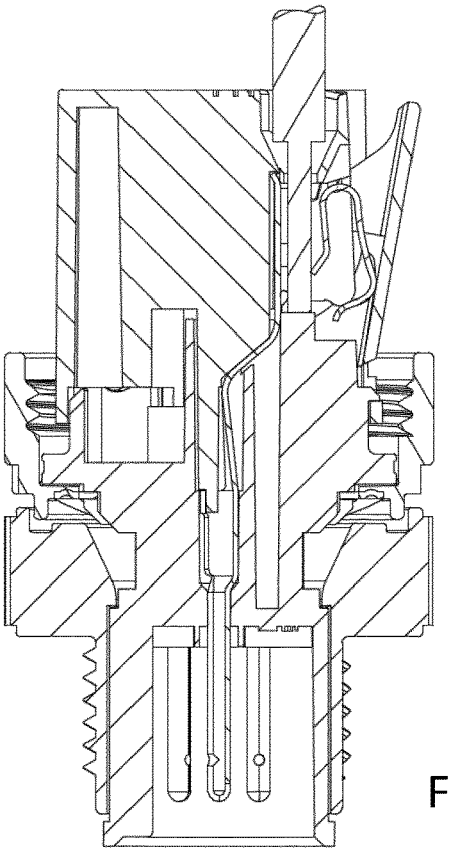
Figure 4A:
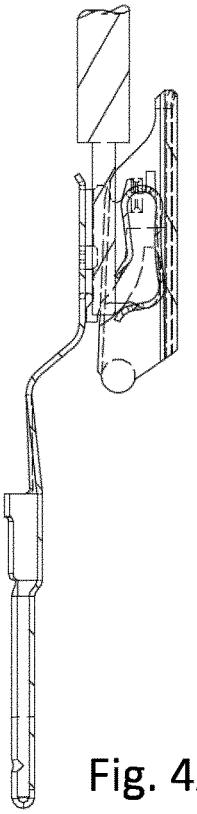
Figure 4B:
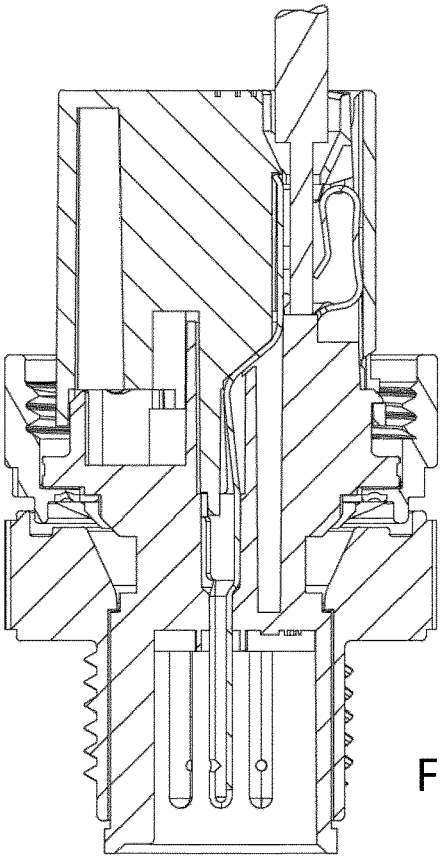

FIGS. 1A to 4A show, in side cross-sectional depiction, a spring-force connection 10 according to the invention in various phases of a transfer of a pivot lever 20 of the spring-force connection 10 from its open position into its closed position, wherein the pivot lever 20 is in its open position in FIG. 1A and in its closed position in FIG. 4A. In FIGS. 1A to 4A, a housing part 11 of the spring-force connection is not shown. FIGS. 1B to 4B show, in a side sectional depiction, a round plug-in connector 1 according to the present invention, wherein the round plug-in connector has a plurality—in the present case five—of spring-force connections 10. The respective pivot levers 20 are in the same positions as the positions shown in FIGS. 1A to 4A.

Figure 5A:
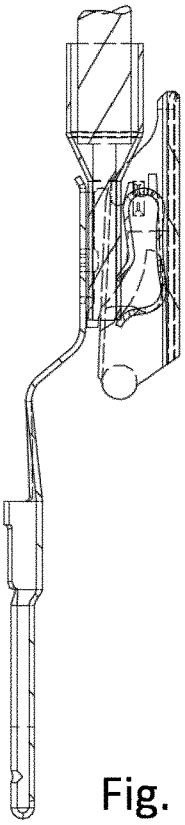
Figure 5B:
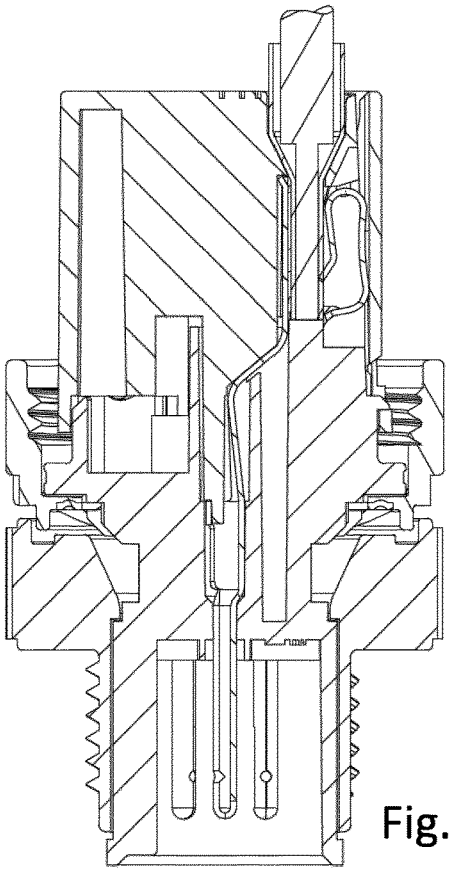
Figure 6A:
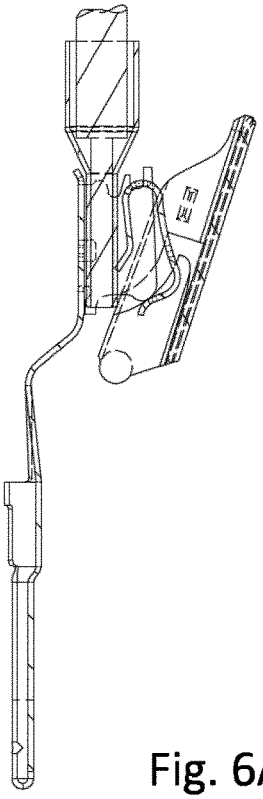
Figure 6B:
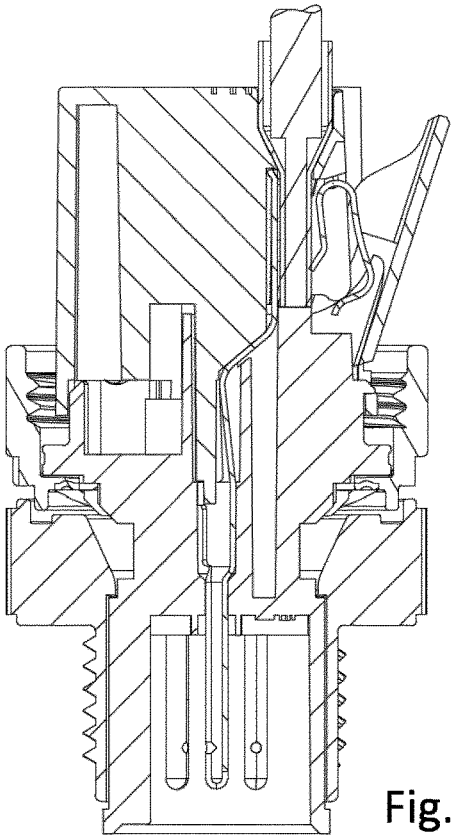
Figure 7A:
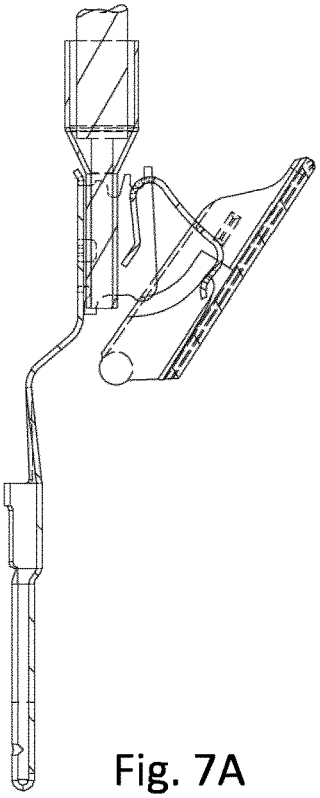
Figure 7B:
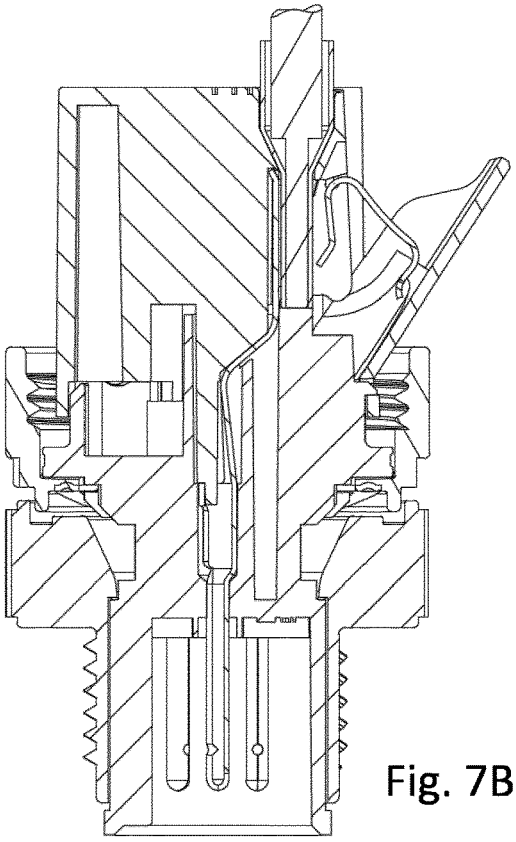

FIGS. 5A to 8A show, in side cross-sectional depiction, the spring-force connection 10 according to the invention in various phases of a transfer of a pivot lever 20 of the spring-force connection 10 from its closed position into its open position, wherein the pivot lever 20 is in its closed position in FIG. 5A and in its open position in FIG. 8A. In FIGS. 5A to 8A again, the housing part 11 of the spring-force connection 10 is not shown. FIGS. 5B to 8B show, in a side sectional depiction, a round plug-in connector 1 according to the present invention, wherein the respective pivot levers 20 are in the same positions as the positions shown in FIGS. 5A to 8A.

FIG. 9 shows the spring-force connection 10 according to the invention alone, in perspective depiction, wherein neither the housing part 11 nor the pivot lever 20 are shown. In FIGS. 10A and 10B, a contact spring 40 of the spring-force connection 10 according to the invention is shown, wherein in FIG. 10A, the contact spring 40 is shown in a top view from the side and in FIG. 10B in a spatial view. The round plug-in connector 1 according to the invention is shown in a spatial depiction in FIGS. 11A and 11B, wherein in the depiction in FIG. 11A, the respective pivot levers 20 of the respective spring-force connections 10 are in the open position, whereas in FIG. 11B, the respective pivot levers 20 are shown in their closed position.

The spring-force connection 10 according to the invention has a housing part 11 which, in the exemplary embodiment shown, is configured as a housing 11 of the round plug-in connector 1. Thus the housing 11 of the round plug-in connector 1 shown in FIGS. 1B to 8B and 11A and 11B forms the respective housing parts 11 of the five spring-force connections 10.

Each spring-force connection 10 has a pivot lever 20 which can be pivoted between an open position and a closed position. In FIGS. 1A and 8A, the pivot lever 20 is shown in its open position, and in FIGS. 4A and 5A, the pivot lever 20 is shown in its closed position. In FIGS. 2A, 3A, 6A and 7A, the pivot lever 20 is shown in intermediate positions between the open position and the closed position.

The spring-force connection 10 according to the invention furthermore comprises an electrically conductive connecting device 30, which is accessible via a conductor insertion opening 13 of the housing 11. The electrically conductive connecting device 30 has a spring basket 31 which in turn has two side walls 32 and a conductor rail 37 arranged between the side walls 32. An electrical conductor L can be positioned between the side walls 32 of the spring basket 31 via the conductor insertion opening 13 in an insertion direction R shown in FIG. 1A.

The spring-force connection 10 furthermore comprises a contact spring 40 by means of which a conductor L, introduced into the housing 11 and between the two side walls 32 via the conductor insertion opening 13, can be force-loaded onto the connecting device 30, or more precisely onto a conductor rail 37 of the connecting device 30.

FIGS. 10A and 10B show that the contact spring 40 has a pressing leg 41 and a clamping leg 45 connected thereto via a bending joint 44. The contact spring 40 furthermore has a latching leg 43 connected to the pressing leg 41 via a latching joint 42. It is evident that the bend of the bending joint 44 is in the same direction as the bend of the latching joint 42. FIGS. 10A and 10B furthermore show that the clamping leg 45 is bent and has a clamping edge 46 at its end.

The contact spring 40 may be pivoted between a release position shown in FIGS. 1A and 8A, and a clamping position shown in FIGS. 4A and 5A. As evident in particular from FIG. 9, the contact spring 40 has two pivot pegs 47 which extend laterally in opposite directions from the bending joint 44, and define a pivot axis 48 of the contact spring 40 about which the contact spring 40 can pivot between the release position and the clamping position. FIG. 9 also shows that a groove 36 is formed in each of the two side walls 32 of the spring basket 31, in the edges 34 facing the conductor insertion opening 13. The contact spring 40 is here suspended in the spring basket 31 such that the pivot pegs 47 are arranged in the grooves 36 of the side walls 32.

As evident in particular from FIG. 1A, the pivot lever 20 has a pressing device 21 which, in the exemplary embodiment shown, is formed as a pressing face 21 of the pivot lever 20. The pressing face 21 or pressing device 21 is here formed as the inner face 21 of the pivot lever 20. The pivot lever 20 furthermore comprises a driver 22 which, in the exemplary embodiment shown, is formed as a bent pin 22 which is connected to the inner face 21 so as to form an intermediate space. As evident in particular from FIG. 4A, when the pivot lever 20 is in the closed position, the pressing leg 41 is arranged between the pressing device 21 and the driver 22 and hence in the intermediate space between the inner face 21 and the driver 22. It is evident from FIGS. 1A to 8A that the latching leg 43 is arranged between the pressing device 21 and the driver 22.

In the exemplary embodiment shown, the contact spring 40 is formed elastically and made for example from a spring steel. Accordingly, an angle between the pressing leg 41 and the clamping leg 45 is variable. Furthermore, an angle between the pressing leg 41 and the latching leg 43 is also variable. When the pivot lever 20 is pivoted into its closed position, the pressing device 21 applies force to the pressing leg 41 via the latching leg 43 such that the contact spring 40 is pivoted into its clamping position, so that the conductor L, introduced into the housing 11 via the conductor insertion opening 13, is force-loaded onto the conductor rail 37 by means of the clamping leg 45. When however the pivot lever 20 is pivoted from its closed position to its open position, wherein a corresponding pivot movement of the pivot lever 20 is shown in FIGS. 5A to 8A, the driver 22 applies force to the pressing leg 41 via the latching leg 43 such that the contact spring 40 is pivoted into its release position.

It is evident from the figures, in particular from FIG. 9, that the spring-force connection 10 has a latching device 35 which, in the exemplary embodiment shown, is formed as two latching protrusions 35 of the edges 34 of the side walls 32 facing away from the conductor insertion opening 13.

As evident in particular from FIGS. 3A and 4A, when the contact spring 40 is pivoted in the direction of its clamping position, the latching leg 43 is in contact with the latching protrusions 35, wherein the angle between the latching leg 43 and the pressing leg 41 is increased by the closing force exerted by means of the pivot lever 20. As evident in particular from FIGS. 4A and 5A, in the closed position of the pivot lever 20, the latching leg 43 engages behind the latching protrusions 35 so that the pivot lever 20 can only pivot in the direction of its open position under elastic deformation of the latching joint 42. As evident in particular from FIG. 6A, when the contact spring 40 pivots in the direction of its release position, the driver 22 applies force to the latching leg 43 such that the angle between the latching leg 43 and the pressing leg 41 is increased by the opening force exerted by means of the pivot lever 20.

The spring-force connection 10 according to the invention is accordingly configured such that, when the pivot lever 20 is transferred from its open position to its closed position, the pressing leg 41 is force-loaded at least indirectly by means of the inner face 21 of the pivot lever 20. When the pivot lever 20 is pivoted from its closed position to its open position however, the pressing leg 41 is force-loaded by the driver 22 by means of the latching leg 43. Accordingly, a forced coupling exists between the position of the pivot lever 20 and the position of the contact spring 40.

It is clear from FIGS. 1A to 8B that the pivot axis 48 of the contact spring 40, about which the contact spring 40 can pivot between the release position and the clamping position, is arranged between the conductor insertion opening 13 and the pressing device 21 and the driver 22 of the pivot lever 20. It is also evident from these figures that the pressing device 21 and the driver 22 of the pivot lever 20 are arranged between the conductor insertion opening 13 and a pivot lever axis 23, about which the pivot lever 20 can pivot between its open position and its closed position. By a corresponding positioning of the pivot axis 48 and the pivot lever axis 23, an opposing rotation of the pivot lever 20 and contact spring 40 always occurs. If for example the pivot lever 20 is pivoted counterclockwise from its open position to its closed position, the contact spring 40 pivots clockwise from its release position to its clamping position. If, however, for example the clamping lever 20 is pivoted clockwise from its closed position to its open position, the clamping spring 40 pivots counterclockwise from its clamping position to its release position.

Because of the elastic design of the contact spring 40, the angle between the pressing leg 41 and the clamping leg 45 is variable so that when the contact spring 40 is in the clamping position, a conductor L can be introduced into the housing 11 via the conductor insertion opening 13, and positioned between the clamping leg 45 and conductor rail 37 under elastic deformation of the contact spring 40. It is evident in particular from FIGS. 4A and 5A that, when the contact spring 40 is in the clamping position, the clamping leg 45 and the conductor rail 37 enclose an angle, open towards the conductor insertion opening 13, of less than 90°. This facilitates insertion of the electrical conductor L into the spring-force connection 10. In addition however, an unintentional extraction of the electrical conductor L from the spring-force connection 10 is countered, since the clamping edge 46 digs into the electrical conductor L and hence counters the extraction of the electrical conductor L when the contact spring 40 is in the clamping position.

LIST OF REFERENCE SIGNS

1 Round plug-in connector
10 Spring-force connection/spring force plug
11 Housing part of spring-force connection/housing of round plug-in connector
12 End face (of housing)
13 Conductor insertion opening (of housing)
20 Pivot lever
21 Pressing device/pressing face (of pivot lever)
22 Driver (of pivot lever)
23 Pivot lever axis
30 Connecting device
31 Spring basket (of connecting device)
32 Side wall (of spring basket)
33 (First) edge (of side wall, facing away from conductor insertion opening)
34 (Second) edge (of side wall, facing towards conductor insertion opening)
35 Latching device/latching protrusion (of connecting device/spring basket/side wall)
36 Groove (of side wall)
37 Conductor rail (of connecting device/spring basket) Plug-in connector (of connecting device)
38 Connecting pin
40 Contact spring/clamping spring
41 Pressing leg (of contact spring)
42 Latching joint (of contact spring)
43 Latching leg (of contact spring)
44 Bending joint (of contact spring)
45 Clamping leg (of contact spring)
46 Clamping edge (of clamping leg)
47 Pivot peg (of contact spring)
48 Pivot axis (of contact spring)
L Electrical conductor
R Insertion direction (of electrical conductor into spring-force connection)

The invention claimed is:

1. A spring-force connection having
a housing part;
a pivot lever which can be pivoted between an open position and a closed position;
an electrically conductive connecting device which is accessible via a conductor insertion opening of the housing part;
a contact spring by means of which a conductor (L) which is inserted into the housing part via the conductor insertion opening can be force-loaded onto the connecting device, wherein the following features:
the contact spring, which can be pivoted between a release position and a clamping position, has a pressing leg and a clamping leg which is connected to said pressing leg by means of a bending joint;
the pivot lever has a pressing device and a driver, wherein the pressing leg is arranged between the pressing device and the driver at least in the closed position of the pivot lever;
by pivoting of the pivot lever into its closed position, the pressing device can at least indirectly apply force to the pressing leg such that the contact spring is pivoted into its clamping position, so that a conductor (L) which is inserted into the housing part via the conductor insertion opening is force-loaded onto the connecting device by means of the clamping leg;
by pivoting of the pivot lever into its open position, the driver can at least indirectly apply force to the pressing leg such that the contact spring is pivoted into its release position.

2. The spring-force connection as claimed in claim 1, wherein:
the contact spring comprises a latching leg which is connected to the pressing leg via a latching joint and is arranged between the pressing device and the driver;
the contact spring is formed elastically at least in portions, and an angle enclosed by the pressing leg and the latching leg is variable;
on pivoting of the contact spring in the direction of its clamping position, the latching leg comes into contact with a latching device of the spring-force connection, wherein the angle between the latching leg and the pressing leg can be increased by a closing force exerted by means of the pivot lever;
in the closed position of the pivot lever, the latching leg engages behind the latching device so that the pivot lever is able to pivot in the direction of its open position only under elastic deformation of the latching joint; and
on pivoting of the contact spring in the direction of its release position, the driver applies force to the latching leg such that the angle between the latching leg and the pressing leg is increased by the opening force exerted by means of the pivot lever.

3. The spring-force connection as claimed in claim 2, wherein:
the electrically conductive connecting device has a spring basket with two side walls and a conductor rail arranged between the side walls;
an electrical conductor (L) can be positioned between the side walls of the spring basket via the conductor insertion opening in an insertion direction (R);
an electrical conductor (L) positioned between the side walls can be force-loaded onto the conductor rail by pivoting of the contact spring into its clamping position by means of the clamping leg; and
the latching device has at least one latching protrusion formed on an edge of a side wall facing away from the conductor insertion opening.

4. The spring-force connection as claimed in claim 2, wherein the contact spring has two pivot pegs which extend laterally in opposite directions from the bending joint and define a pivot axis of the contact spring, about which the contact spring can pivot between the release position and the clamping position.

5. The spring-force connection as claimed in claim 4, wherein:

the contact spring furthermore comprises a latching leg which is connected to the pressing leg via a latching joint and is arranged between the pressing device and the driver;

the contact spring is formed elastically at least in portions, and an angle enclosed by the pressing leg and the latching leg is variable;

on pivoting of the contact spring in the direction of its clamping position, the latching leg comes into contact with a latching device of the spring-force connection, wherein the angle between the latching leg and the pressing leg can be increased by a closing force exerted by means of the pivot lever;

in the closed position of the pivot lever, the latching leg engages behind the latching device so that the pivot lever is able to pivot in the direction of its open position only under elastic deformation of the latching joint; and on pivoting of the contact spring in the direction of its release position, the driver applies force to the latching leg such that the angle between the latching leg and the pressing leg is increased by the opening force exerted by means of the pivot lever, the electrically conductive connecting device has a spring basket with two side walls and a conductor rail arranged between the side walls;

an electrical conductor (L) can be positioned between the side walls of the spring basket via the conductor insertion opening in an insertion direction (R);

an electrical conductor (L) positioned between the side walls can be force-loaded onto the conductor rail by pivoting of the contact spring into its clamping position by means of the clamping leg; and the latching device has at least one latching protrusion formed on an edge of a side wall facing away from the conductor insertion opening, a groove is formed in each of the two side walls of the spring basket on an edge facing the conductor insertion opening; and the contact spring is suspended in the spring basket such that the pivot pegs are arranged in the grooves of the side walls.

6. The spring-force connection as claimed in claim 2, wherein a pivot axis of the contact spring, about which the contact spring can pivot between the release position and the clamping position, is arranged between the conductor insertion opening and the pressing device and/or the driver of the pivot lever.

7. The spring-force connection as claimed in claim 2, wherein the pressing device and the driver of the pivot lever are arranged between the conductor insertion opening and a pivot lever axis, about which the pivot lever can pivot between the open position and the closed position.

8. The spring-force connection as claimed in claim 2, wherein the contact spring is configured elastically at least in portions, and an angle enclosed between the pressing leg and the clamping leg is variable so that, when the contact spring is in the clamping position, a conductor can be introduced into the housing part via the conductor insertion opening and positioned between the clamping leg and the conductor rail under elastic deformation of the contact spring.

9. The spring-force connection as claimed in claim 8, wherein the connecting device has a conductor rail with which a conductor, introduced into the housing part via the conductor insertion opening, can be brought into contact, wherein when the contact spring (40) is in the clamping position, the clamping leg and the conductor rail enclose an angle, open towards the conductor insertion opening, of less than or equal to 90°.

10. A round plug-in connector including a plurality of spring-force connections as claimed in claim 2, wherein a housing of the round plug-in connector forms the housing parts of the spring-force connections, and wherein the respective conductor insertion openings of the spring-force connections are arranged on an end face of the housing.

11. The round plug-in connector as claimed in claim 10, wherein the respective spring-force connections are arranged relative to each other such that the respective pivot levers of the spring-force connections are arranged with an angular offset to each other on a circumference of the housing.

12. The spring-force connection as claimed in claim 3 wherein the contact spring has two pivot pegs which extend laterally in opposite directions from the bending joint and define a pivot axis of the contact spring, about which the contact spring can pivot between the release position and the clamping position.

13. The spring-force connection as claimed in claim 3, wherein a pivot axis of the contact spring, about which the contact spring can pivot between the release position and the clamping position, is arranged between the conductor insertion opening and the pressing device and/or the driver of the pivot lever.

14. The spring-force connection as claimed in claim 4, wherein a pivot axis of the contact spring, about which the contact spring can pivot between the release position and the clamping position, is arranged between the conductor insertion opening and the pressing device and/or the driver of the pivot lever.

15. The spring-force connection as claimed in claim 5, wherein a pivot axis of the contact spring, about which the contact spring can pivot between the release position and the clamping position, is arranged between the conductor insertion opening and the pressing device and/or the driver of the pivot lever.

16. The spring-force connection as claimed in claim 3, wherein the pressing device and the driver of the pivot lever are arranged between the conductor insertion opening and a pivot lever axis, about which the pivot lever can pivot between the open position and the closed position.

17. The spring-force connection as claimed in claim 4, wherein the pressing device and the driver of the pivot lever are arranged between the conductor insertion opening and a pivot lever axis, about which the pivot lever can pivot between the open position and the closed position.

18. The spring-force connection as claimed in claim 3, wherein the contact spring is configured elastically at least in portions, and an angle enclosed between the pressing leg and the clamping leg is variable so that, when the contact spring is in the clamping position, a conductor can be introduced into the housing part via the conductor insertion opening and positioned between the clamping leg and the conductor rail under elastic deformation of the contact spring.

19. A round plug-in connector with a large number of spring-force connections as claimed in claim 3, wherein a housing of the round plug-in connector forms the housing parts of the spring-force connections, and wherein the respective conductor insertion openings of the spring-force connections are arranged on an end face of the housing.

20. A round plug-in connector with a plurality of spring-force connections as claimed in claim 4, wherein a housing of the round plug-in connector forms the housing parts of the spring-force connections, and wherein the respective conductor insertion openings of the spring-force connections are arranged on an end face of the housing.

* * * * *